United States Patent [19]

Kruger, Jr. et al.

[11] 4,324,405

[45] Apr. 13, 1982

[54] BOARD GAMES HAVING VARIABLE GAME-PIECE-ENERGIZED CIRCUITS

[75] Inventors: Frederick W. Kruger, Jr., Churchville, Pa.; Warren E. Bosch, Beverly, N.J.

[73] Assignee: Product Dynamics, Ltd., Levittown, Pa.

[21] Appl. No.: 135,955

[22] Filed: Mar. 31, 1980

[51] Int. Cl.[3] ..... A63F 3/00

[52] U.S. Cl. ..... 273/238; 273/248

[58] Field of Search ..... 273/237, 238, 248, 282; 434/340, 341

[56] References Cited

U.S. PATENT DOCUMENTS

| | | | |
|---|---|---|---|
| 2,452,341 | 10/1948 | Wasserman | 273/282 X |
| 2,673,404 | 3/1954 | Abrahamson . | |
| 3,187,443 | 6/1965 | Schure et al. | 434/340 X |
| 3,653,026 | 3/1972 | Hurley . | |
| 3,697,076 | 10/1972 | Vogel . | |
| 3,733,074 | 5/1973 | Daley . | |
| 3,844,564 | 10/1974 | Barish . | |
| 3,854,725 | 12/1974 | Cluck | 273/238 |
| 3,856,307 | 12/1974 | Tinman | 273/238 |
| 3,893,671 | 7/1975 | Gardner . | |
| 4,021,044 | 5/1977 | Matsumoto | 273/238 |
| 4,210,335 | 7/1980 | Licciardi | 273/238 |

FOREIGN PATENT DOCUMENTS

| | | | |
|---|---|---|---|
| 393190 | 6/1933 | United Kingdom | 273/238 |

*Primary Examiner*—Richard C. Pinkham
*Assistant Examiner*—Scott L. Brown
*Attorney, Agent, or Firm*—Frederick A. Zoda; John J. Kane; Albert Sperry

[57] ABSTRACT

A game board includes an electrical circuit grid underlying a playing surface having a plurality of paths for game pieces each capable of being electrically activated by being placed in a circuit with grid elements disposed in the path along which the game piece is moved. An electrically actuated piece produces a visual and/or audible indication to a player that the game piece is in electrical contact with a "live" portion of the circuit grid. Whether a particular portion of the grid is or is not "live" is determined by the location of a circuit selector switch which closes or opens electrically distinct areas of the grid when operated by a player in accordance with instructions received from a spinner whose operation is governed entirely by the laws of chance. Advancement of the playing pieces along their paths is effected by players according to the instructions received from the spinner, after the circuit selector has been adjusted to a new position. Progress of a game piece along its path, or the lack of such progress, is made dependent upon whether or not the game piece when advanced reaches a portion of the circuit grid that has been rendered "live" and hence has actuated the visual and/or audible signal element carried by the moved game piece.

4 Claims, 8 Drawing Figures

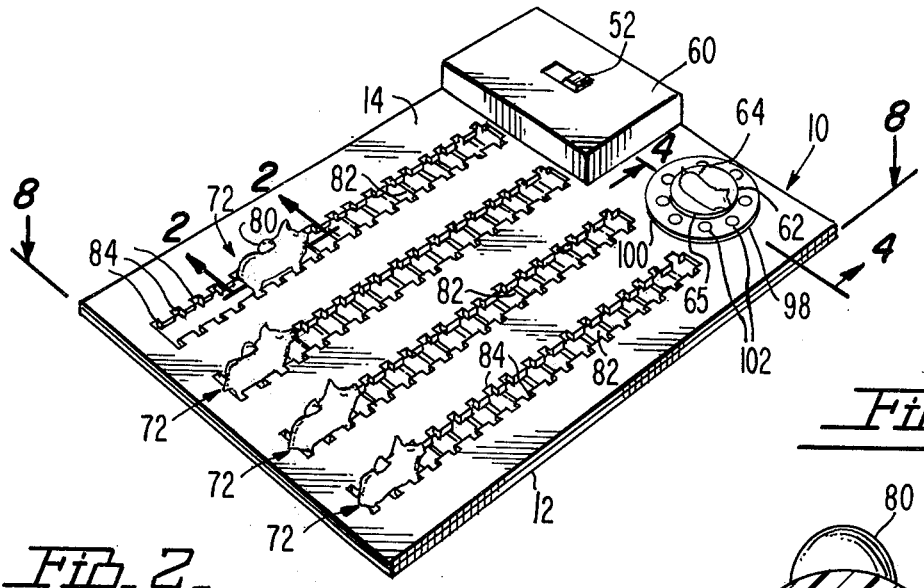
Fig. 1.
Fig. 2.
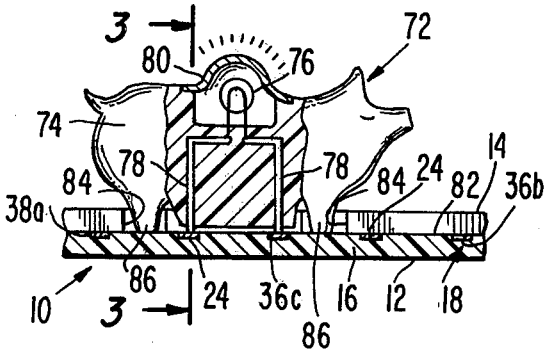
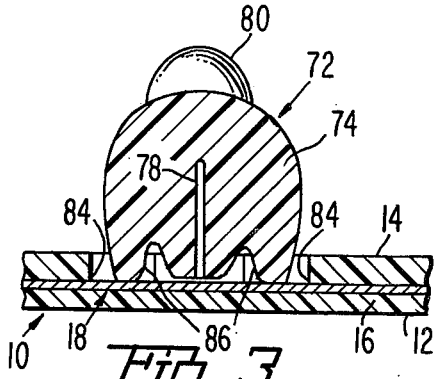
Fig. 3.
Fig. 6.
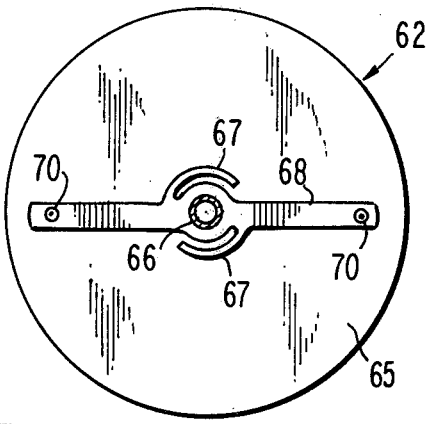
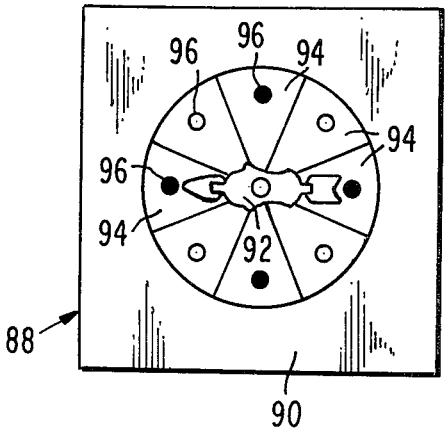
Fig. 5.
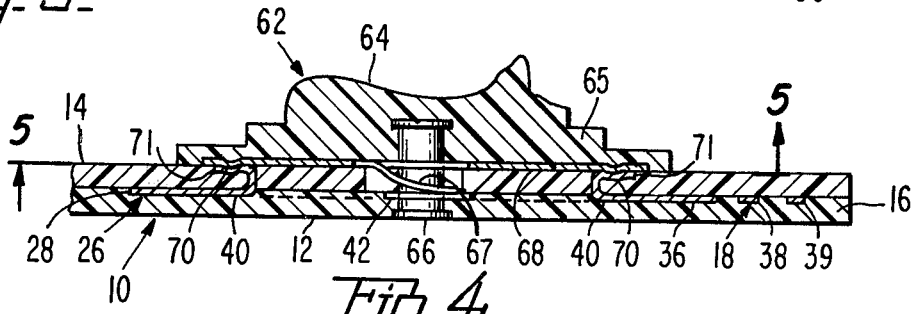
Fig. 4.

BOARD GAMES HAVING VARIABLE GAME-PIECE-ENERGIZED CIRCUITS

BACKGROUND OF THE INVENTION

1. Field of the Invention

The invention relates generally to games, and more particularly to board games of the electrical type, having definitely movable game pieces that interact electrically with the board itself, in different positions to which the game pieces are moved along paths prescribed for the individual pieces.

2. Description of the Prior Art

Electrical game boards, having circuit grids, are per se well known. Generally representative of this type of game apparatus are the U.S. Pat. Nos. to Vogel 3,697,076; and Gardner 3,893,671. These, however, leave something to be desired, although certainly recognizable as being capable of evoking considerable player interest. For example, in the prior art devices, the circuitry incorporated in the game board remains live at all times, through its entire area, and it is left to the playing pieces themselves to determine whether or not electrically actuated signal means becomes energized, that is, the position or orientation of the playing or game pieces becomes a factor or in many instances the sole factor in determining whether a particular movement of the game piece is or is not a successful one.

This produces, in many instances, undesirable complexity in the game board construction, and this of course is something that should be avoided if at all possible, in order to produce a commercially feasible product. Additionally, in many instances the complexity of the mechanism and in some instances, the requirement that a certain amount of skill be used, detracts measurably from the use of the game board as an amusement device for young children, who are understandably frustrated in the presence of game situations that have a complexity and skill requirement beyond their tender years.

Still further, in many instances the electrical game boards of the prior art have been so designed as to incorporate concepts that are usable for no more than one particular game, as for example chess, checkers, or bingo, and again this detracts from the commercial feasibility of the inventive concepts involved in prior art devices having this particular characteristic. It is desirable, rather, that a game board incorporate an inventive concept which permits it to be utilized over and over again by manufacturers, in games that are seemingly different, hence attractive to a wide variety of age groups and customer preferences, and yet utilize in common the same basic electrical circuitry and operating concepts.

SUMMARY OF THE INVENTION

Summarized briefly, the invention utilizes an electrical game board, having a circuit grid incorporated in it. The grid in its most basic aspects includes opposite sides of a circuit, with at least one of the opposite sides being comprised of a plurality of individual circuit elements. Branch circuit elements are provided on each of the opposite sides of the circuit, being disposed in alternating relation so as to permit closing of a circuit through a source of electrical power whenever a game piece is in straddling relation to branch circuit elements of opposite polarity. By means of a selector mechanism, the several individual circuit elements of one of the sides of the circuit are individually brought into and out of circuit with the source of power. As a result, at all times there are "live" and "dead" portions on at least one of the opposite sides of the electrical circuit incorporated in the game board. Whether a particular portion of the circuitry is "live" or "dead" is something that is unknown to any of the players, because the circuit grid incorporated in the game board, and the selector used for activating or de-activating different portions of the circuit, do not provide any visual indication in and of themselves to the players as to what portions of the circuit may or may not be energized at a given time. Rather, this is dictated by a chance device such as a spinner, which when operated provides instructions as to the position of the circuit control selector device.

Incorporated in the game board are paths for game pieces, said paths permitting electrical interaction between each game piece and the circuitry underlying the path along which the piece is moved. As a result, under instructions received from the spinner, a player moves the game piece a prescribed distance along its path. When the game piece is moved the permitted distance, it comes to rest in a position in which it will interact electrically with the circuitry underlying the path at the particular point where the game piece comes to rest. If this particular area of the circuit grid is live, then visual and/or audible indications are provided. For example, each game piece may incorporate a small electrical lamp, the opposite terminals of which contact circuit branch elements of opposite polarity when the game piece comes to rest at the end of its permitted advancement along its path. If per chance the circuit branch elements contacted are live, the lamp will be energized. If on the other hand the underlying circuit branch elements are dead, that is, have not been brought into circuit with the source of electrical power, the signal will not be activated.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective view of a game board according to the present invention;

FIG. 2 is an enlarged, detailed sectional view taken substantially on line 2—2 of FIG. 1 illustrating one of the game pieces as it appears when advanced successfully along its path toward the finish point;

FIG. 3 is a transverse sectional view substantially on line 3—3 of FIG. 2 illustrating the game piece and its associated path in cross section;

FIG. 4 is an enlarged, detailed, fragmentary sectional view through the rotary circuit control means or selector, substantially on line 4—4 of FIG. 1;

FIG. 5 is a horizontal section, on a scale smaller than that of FIG. 4, taken substantially on line 5—5 of FIG. 4 and illustrating the underside of a typical circuit control selector;

FIG. 6 is a plan view, a portion being broken away, of the spinner used as part of the game device in a preferred embodiment;

DETAILED DESCRIPTION OF THE PREFERRED EMBODIMENT

Figure 7:
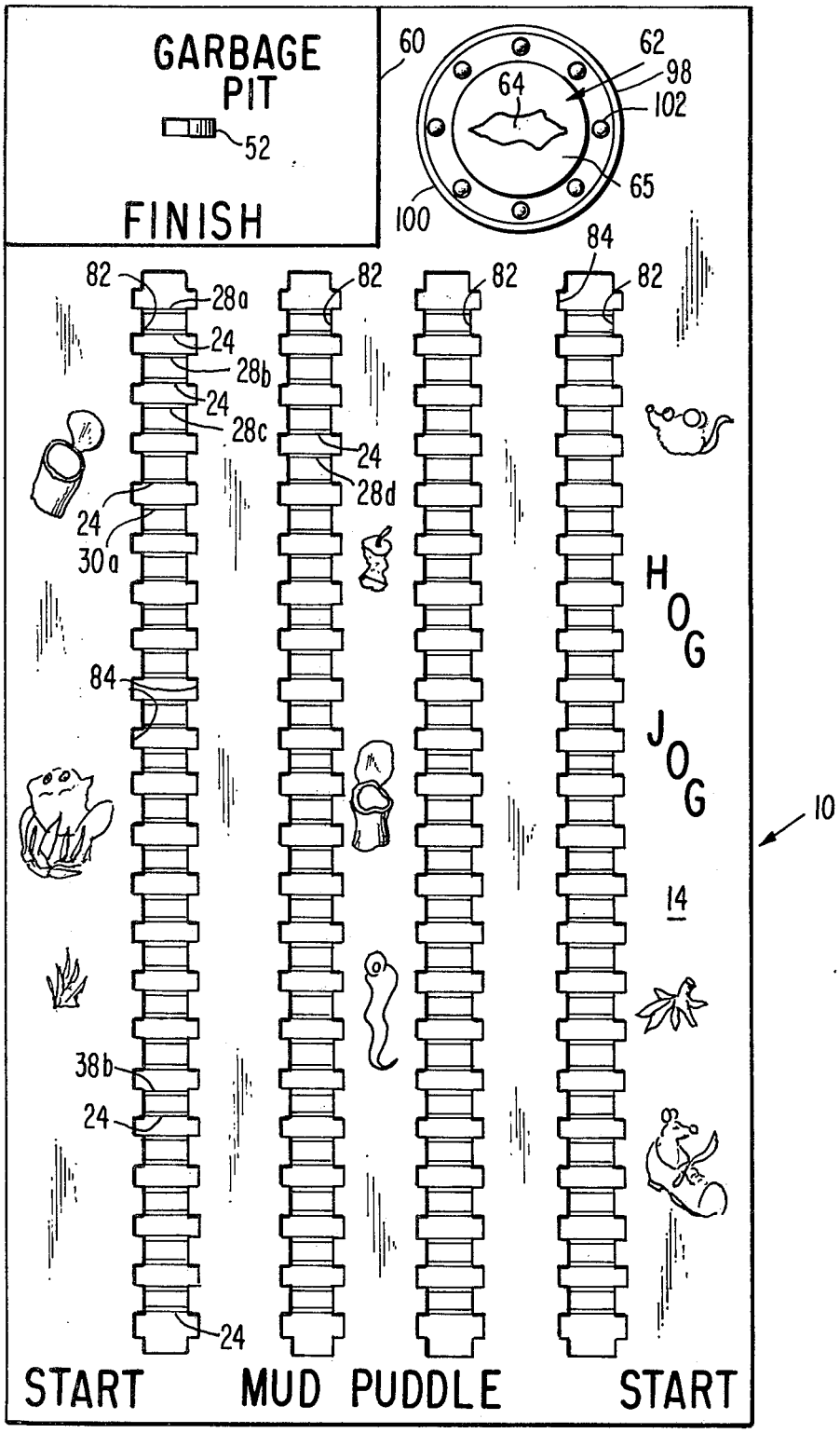
FIG. 7 is an enlarged top plan view of the game, a portion being broken away.

Before proceeding to a detailed description of the drawing, it is appropriate to note that in the illustrated example, the game board has been shown as one adapted especially to interest and amuse younger children. Thus, in the illustrated example of the game board has a number of paths representing travel from a mud puddle to a garbage pit. The game pieces are in the simulation of small pigs, and the goal is to travel to the garbage pit from the mud puddle, so that the winning pig may wallow in and presumably partake of the garbage at the finish line.

This is, of course, merely one embodiment of the game, and it is understandable that the game could utilize pieces in the form of spaceships, automobiles, etc., respectively traveling to far-off galaxies, or in the case of automobiles, police cars, or taxis, through a labyrinthine maze of city streets. The various embodiments in which the game may be commercially produced are, it is believed, almost limitless. It is sufficient to note that in every instance, the game will have the structural and functional essentials illustrated and described herein, and no attempt will be made to discuss game rules or particular games that can be played, except to the extent absolutely necessary for the purpose of providing an understanding of how the game structure illustrated and described herein is constructed and used.

In the illustrated embodiment, a game board 10 is formed as a laminate, rectangular, flat assembly of a base or circuit grid support plate 12 underlying and permanently secured in face-to-face contact with a cover plate or playing surface 14.

The circuit grid support plate 12, in the illustrated embodiment, comprises a base plate member 16 formed of electrically insulative material, having on its upper surface a circuit grid generally designated 18. The circuit grid can be a printed circuit, or alternatively, it could be formed of electrically conductive foil, ink, wires, or any other suitable means adapted to provide electrical paths within the grid.

Grid 18 basically comprises first and second sides of opposite polarity. The first side has been generally designated 20, and as seen from FIG. 8, in the illustrated embodiment includes an elongated, straight main circuit element 22 which in the illustrated example extends longitudinally of the game board along one side edge thereof. The main circuit element 22 is integral with a plurality of branch circuit elements 24 extending perpendicularly to the main element, transversely of the game board over a substantial portion of the width of the board. The branch elements 24, in the illustrated example, are uniformly, closely spaced along the length of the main circuit element 22, and can be of any desired number, there being 22 branch elements extending from the main circuit element 22 of side 20, in the illustrated example.

The opposite side of the circuit has been generally designated 26. In the illustrated example, this includes a plurality of individual, separate main circuit elements 28, 30, 32, 34, 36, 38, and 39 respectively. Again, the number may differ from game to game. Indeed, the first side 20 of the circuit could itself comprise a plurality of individual main circuit elements, rather than a single main circuit element 22.

Each of the main circuit elements 28 through 39 of what has been generally termed the opposite side 26 of the circuit has a plurality of individual branch elements alternating with and paralleling branch circuit elements 24 of the first side 20. Thus, circuit element 28 in the illustrated example has four, parallel branch elements **28*a*, 28*b*, 28*c*, 28*d* disposed in alternating, spaced parallel relation to branch circuit elements 24 of the first side 20 of the circuit incorporated in the game board. Main circuit element 30 is provided with three branch circuit elements 30*a*, 30*b*, 30*c* alternating with other branch circuit elements 24 of the first side. Main circuit element 32 has three branch circuit elements 32*a*, 32*b*, 32*c*; main element 34 has branch elements 34*a*, 34*b*, 34*c*; main element 36 has branch elements 36*a*, 36*b*, 36*c*; main element 38 has branch elements 38*a*, 38*b*, 38*c*; and main element 39 has branch elements 39*a*, 39*b*, and 39*c*. All the branch elements of the second side 26 of the circuit are in a ladder-like arrangement, in alternating, spaced relationship to the branch elements 24 of the first side 20** of the circuit.

Figure 8:
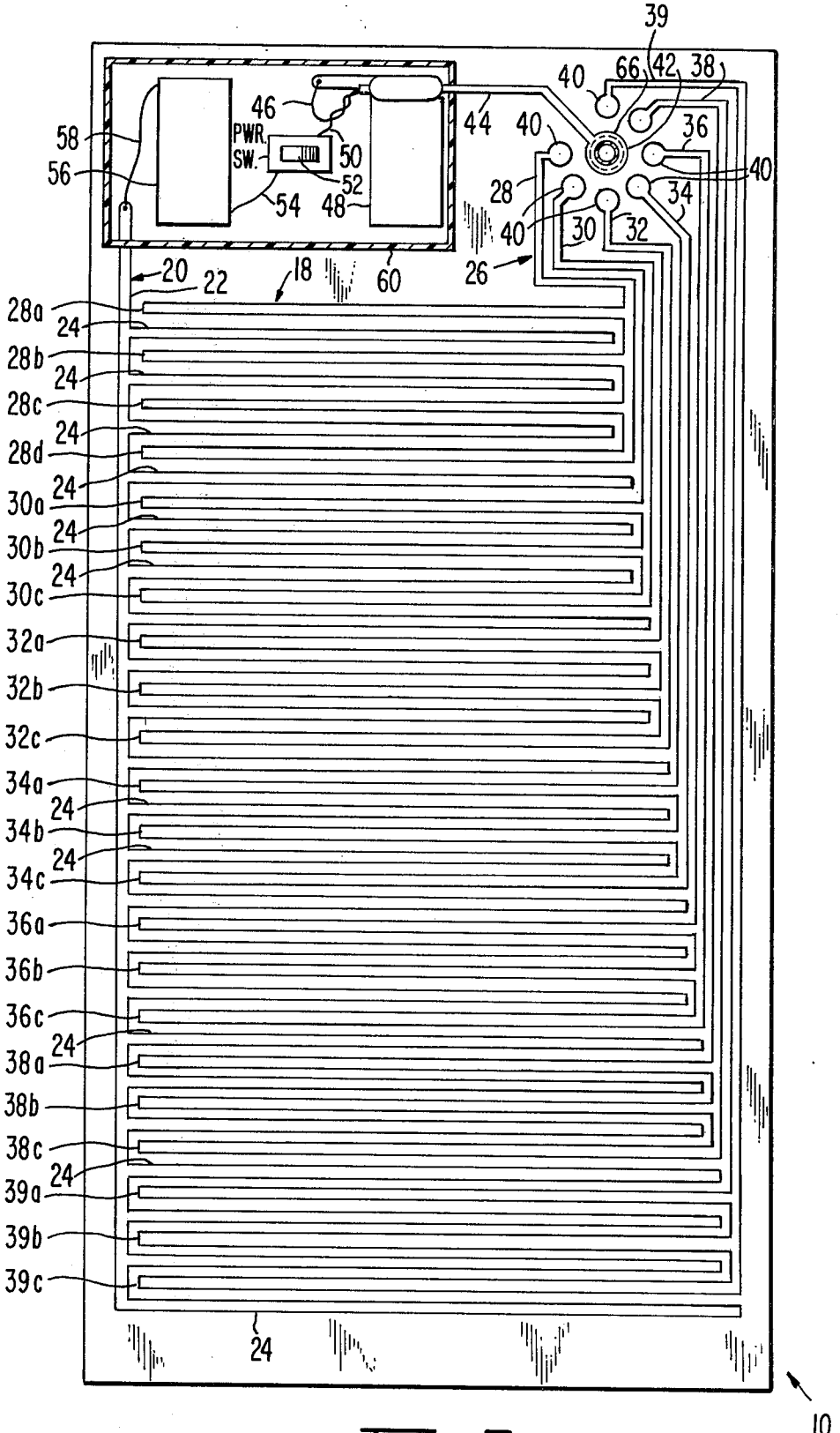
FIG. 8 is a view on the same scale as FIG. 7, showing the circuit grid-supporting base member of the game board, the view being taken substantially on line 8—8 of FIG. 1.

It is also important to note that the plurality of main circuit elements 28 through 39 of the second side 26 of the circuitry are normally free of any electrical connections to each other. Rather, each of the main circuit elements 28 through 39, at the end thereof remote from its branch elements, is formed with an electrical terminal 40. The several terminals 40, as seen from FIG. 8, are arranged in an annular series, about a common terminal 42 centered in said series and formed upon the end of a common circuit connection 44 connected to an electrical lead 46 that is attached to one pole of a removable battery 48, from the other pole of which extends a lead 50 connected to one terminal of a main power control switch 52, the other terminal of which is connected to a lead 54 extending to one terminal of a flasher control device 56 connected at its other terminal by lead 58 to the main circuit element 22 of the first side 20 of the circuit.

The battery, switch, and flasher control device 56 can all be enclosed in a housing 60, which of course would be made readily removable so as to facilitate replacement or recharging of the battery.

The connection of the individual circuit elements 28 through 39 of the second side 26 in circuit with the battery 48 is controlled by a circuit selector generally designated 62 and illustrated in FIGS. 4 and 7 as incorporating a diametrically extending, integral handle 64 which in the illustrated example, but obviously not necessarily, is in the simulation of an animal, in particular a pig, to increase its attractiveness to youthful players. The body 65 of the selector is of electrically insulative material, and has a flat underside overlying the several terminals 40 and the common terminal 42. Centrally provided in the body is a tubular sleeve 66, constituting a spindle or stub shaft extending downwardly from the body into registering bearing openings formed in the plates 14, 16 of the game board, so as to rotatably mount the selector 62 upon the playing surface as shown. In a preferred embodiment, the stub shaft or spindle 66 is so designed as to permit the selector to be bodily removed from the plates 14, 16, so that another selector can be substituted if desired. The purpose of facilitating ready substitution of one selector for another is to increase the versatility of the game, by having various types of electrical bridging elements 68, any of which can be utilized. Referring to FIG. 5, and also to FIG. 4, it will be seen that secured to the underside of the body 65 of the selector, is a diametrically extending bridging element 68 of electrically conductive material, having at its ends detents 70 engageable in electrically conductive pads 71 of the several terminals 40.

Bridging element 68 is formed (see FIG. 5) with diametrically opposed, spirally extending, integral wiping contacts 67, 67 which engage the center terminal 42 (see FIG. 4) to maintain the bridging element in electrical engagement with the center terminal in the various positions to which the selector is rotated.

It will thus be seen that utilizing a selector such as shown in FIG. 5, operation of the selector to a given position will connect two of the circuit elements of the second side 26 of the circuit, in circuit with the battery, so that they are "live". All other circuit elements will be "dead" in the sense that no electrical current can flow therethrough, since they will not be connected to the battery. For example, if the selector is adjusted to a position in which the diametrically extending bridging element 68 engages the terminals 40 of circuit elements 28 and 36, these circuit elements will be connected through the common terminal 42 and common circuit connection 44, in circuit with the battery and hence will be "live". Referring to FIG. 4 it may be noted that wiper arms extending downwardly from the central portion of the bridging element provide an electrical connection between the bridging element and the common terminal 42 so as to effect the connection of the selected elements 28, 30, 32, 34, 36, 38, or 39 to the battery.

In another position of the selector, the elements 30, 38 would be connected to the battery. In yet another position, elements 32, 39 would be so connected. In still another position, the element 34 would be connected to the battery.

It is possible, by substitution of one selector for another, to utilize selectors that have, for example, cruciform or T-shaped bridging elements. A cruciform bridging element would provide four bridging terminals, and would have the capability of connecting up to four of the elements 28 through 39 to the source of electrical power. A T-shaped element would connect three of said circuit elements to the source of power. It follows, of course, that the bridging element could simply be a radial arm extending from the center of the selector, so as to permit only one of the circuit elements of the side 26 to be connected to the source of electrical power.

All of these modifications are believed sufficiently obvious as not to require special illustration herein. It is mainly important to note that the selector element, when rotated by the players during the course of a game, is continually changing those areas of the second side 26 that are "live" or "dead" electrically. This adds measurably to the interest in the game, since the players do not know which of said circuit areas are alive or dead at any given point during the course of the game.

In the playing of the game, a plurality of game pieces 72 are employed. In the illustrated example these are in the simulation of piglets, and are of different colors, each game piece incorporating a molded body of electrically insulative material 74, having in its top surface a recess in which is mounted a signal lamp 76, connected by embedded leads 78 to exposed terminals provided upon the underside of the body in positions where they are adapted to contact a branch circuit element 24 of circuit side 20, and a branch circuit element, as for example element 36*c* of the opposite side 26 of the circuit. It follows that with circuit element 24 being alive at all times, the signal lamp 76 will be energized when, and only when, the branch element of the opposite side 26 (in the illustrated example the element 36*c*) is energized according to the position of the selector 62 at that time.

In the selector position shown in FIGS. 1 and 4, the signal lamp 76 would be illuminated for the playing piece illustrated in FIG. 2, because the selector has connected circuit element 36 in circuit with the battery, along with circuit element 28, so that branch element 36*c* is live. Accordingly, a circuit would be closed through the signal lamp 76 and the source of power, providing a visual indication that a successful move of the game piece along its assigned path has been achieved. This successful move is rewarded according to the particular game rules, and in the present example may result in the player being allowed to leave the game piece in the position to which it has been advanced. If advancement of the playing piece results in no energizing of the signal lamp 76, the game rules may require that the piece be moved backwards, space by space, until the signal lamp again begins to blink by reason of its connection to the source of power through the flasher 56.

To protect the signal lamp there may be provided upon each of the playing piece bodies 74, a dome-shaped, transparent shield 80.

The game pieces are movable along paths 82 formed as slots extending the full depth of the cover plate 14. In the illustrated example, the slots are approximately parallel, and if desired they may curve somewhat as they extend from the start to the finish line denoted by the opposite ends of the respective slots. Each slot, in the illustrated example, has opposed longitudinal edges formed with uniformly spaced, relatively shallow notches 84 representing steps along which the playing pieces 72 may be advanced. In the illustrated example, since the playing pieces are in the form of piglets, each playing piece has four legs 86, adapted to be disposed in slots 84 whenever the playing piece is advanced. When the legs 86 of the playing piece are so disposed in opposing slots as illustrated in FIGS. 2 and 3, the contacts defined by the lower ends of the leads 78 are in engagement with adjacent branch circuit elements of the respective sides 20, 26 of the circuit. As previously noted, if the branch element of the side 26 happens to be energized at the particular time by reason of the selector position, the signal will be activated in the playing piece. Thus, advancing the playing piece step by step assures that in every position to which the playing piece is so advanced, the contacts of its signal device will be in engagement with opposite sides of the circuit grid 18.

Referring to FIG. 6, a spinner is provided, and in the illustrated example, the spinner has been designated 88 and incorporates a rectangular, flat spinner base 90 on which is freely rotatable an indicator member 92. This is in the general simulation of the usual arrow, so that when it comes to rest it will point to index markings 96 provided in colored segments 94 of the spinner.

The rotary selector 62 has markings 98, 100, 102 bearing a relationship to the markings 94, 96 of the spinner. For example, let it be assumed that the segments 94 of the spinner are of various colors such as yellow, blue, red or green. Let it also be assumed that along each path 82 there are corresponding colored areas. If the game piece 72 is at the starting end of the path, shown at the left in FIG. 1, and assuming that the spinner arrow has come to rest in the segment 94 that is colored green, the player whose turn it is advances his or her game piece to the first space of the path that is colored green. Note, in this connection, that the markings 96 of the spinner, in a typical embodiment, alternate between black and white. Thus, in FIG. 6 the spinner arrow has come to rest in a segment which for purposes of explanation will be considered green, having in it a black dot or marking 96. As previously noted, the player moves his playing piece to the next position in the path 82 that is colored green.

The player now turns the selector 62 to the corresponding color combination, in this case black-green. Referring to FIG. 7, imprinted upon the game board, and extending about the selector, are opposed black and white boundary markings 98, 100 respectively each of which is disposed in proximity to a series of colored, angularly spaced indicia 102. Let it be assumed, thus, that the spinner having indicated black-green as a combination, the player has advanced his piece to the next green area of his assigned path 82, and has indexed the selector 62 to a position in which the head of the animal simulation 64 points to the green indicium 102 associated with and adjacent to black boundary marking 98.

In these circumstances, and keeping in mind that side 20 of the circuit is continuously connected to one side of the battery or other power source, the rotary selector will have connected to the other side of the battery the main circuit elements 28 and 36 of the second side 26 of the circuit. If it happens that the advanced piece is in contact with a live portion of side 26 of the circuit grid, the signal device 76 of that playing piece will be energized. In the present instance this is a lamp and it will blink by reason of the operation of the flasher. In a typical playing situation, this may permit the player to leave his playing piece at the location to which it has been advanced. If, on the other hand, the signal device is not energized, the rules may require that the player move the piece in a reverse direction, space by space, until the signal thereof eventually makes a circuit with a live portion of side 26 and is again energized. Under the rules of the game, the player may under these circumstances halt the step by step reverse movement of his playing piece and leave it in the position to which it has been reversely moved until the players next turn arrives.

Obviously, the paths along which the playing pieces are moved do not have to be parallel, nor straight, and can follow various tortuous and even intersecting routes. It is necessary, only, that each path along which a playing piece is moved be crossed, at regular or even irregular intervals, by circuit elements of opposite polarity capable of being contacted by the terminals of the visual and/or audible signal device carried by the playing piece. And, as previously noted, so far as the circuitry is concerned, it is an important feature that at least one of the sides of the circuit comprise a multiplicity of circuit elements, not connected to each other, but capable of being brought either singly or in any combination thereof into circuit with the source of power, so as to have both live and dead circuit areas in at least one, and if desired in both, sides of the circuit.

It is contemplated that in some instances, the game pieces may not have electrical means incorporated directly therein for the purpose of providing signals indicating a successful advance of the piece. For example, the playing pieces may be weighted, and the circuit grid may be sensitive to the weight of a playing piece in such a way as to close switches spaced along the paths 82, whereby to actuate other electrical means located on the game board, including lights, buzzers, sirens, or the like. This arrangement, of course, would have in common with the illustrated arrangement the characteristic whereby the advancement of a playing piece to a "live" circuit area determined by the selector position, is effective to provide a visual and/or audible indication to the players resulting from a mechanical or electrical interaction between the playing piece and the underlying circuit grid.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A game comprising:

(a) a base plate having a circuit grid including:

(1) a first side of a given polarity formed with a single elongated main circuit element and with several branch elements connected to and extending from the main element at one end thereof;

(2) a second side of opposite polarity formed with a multiplicity of circuit element groups each including an elongated main element and several branch elements all of which are connected to and extend from one end of the main element of the same group, the branch elements of the first side alternating with and extending generally parallel to the branch elements of each of the several groups that comprise said multiplicity of groups, said main elements of the several groups having terminals at their other ends arranged in an annular series, (3) a common terminal centered in said series, (4) means for connecting the common terminal and the other end of the main circuit element of the first side to opposite sides of a source of electrical power, and (5) a circuit selector overlying said common terminal and the several terminals of the annular series and having a bridging element for connecting the common terminal to at least one but less than all the terminals of said series, in selected positions to which the selector is rotated;

(b) a cover plate overlying and laminated with the base plate and having a series of slots each of which extends across all the branch elements of both sides of the circuit but omits traverse of the main elements;

(c) playing pieces each of which is movable along an associated slot and includes a signal element and contacts that are in circuit therewith and are engageable with adjacent branch elements of the respective sides of the circuit in each position to which the playing pieces are moved along the slots; and (d) means for determining by chance the extent to which each of the playing pieces may be advanced within its associated slot.

2. A game as in claim 1 wherein the bridging element of the selector extends diametrically of the selector and is formed at its end with detents, the several terminals of the annular series having electrically conductive paths in which the detents are engageable in each position to which the selector is moved.

3. A game as in claim 2 wherein the selector bridging element has intermediate its ends spirally extending, diametrically opposed wiping contacts adapted to engage said center terminal in each position to which the selector is rotated.

4. A game as in claim 1 wherein each of said slots has opposite longitudinal edges formed with notches uniformly, regularly spaced along the length of the slot, the notches of each slot being arranged in pairs in which the notches of a pair are transversely aligned, each playing piece having legs engageable in the notches in each position to which the playing piece is advanced along the length of the slot, there being one pair of notches for each branch element traversed by the slot in which said pair is formed, the pairs being so arranged relative to the branch elements traversed by the slot as to require that the contacts of the playing piece engage one branch element of the first side of the circuit and one branch element of one of the groups of the second side of the circuit upon each advancement of a playing piece to the next pair of notches during movement of the playing piece from one end of its associated slot to the other end thereof.

* * * * *

UNITED STATES PATENT AND TRADEMARK OFFICE

CERTIFICATE OF CORRECTION

PATENT NO. : 4,324,405

DATED : April 13, 1982

INVENTOR(S) : Frederick W. Kruger; Warren E. Bosch

It is certified that error appears in the above-identified patent and that said Letters Patent are hereby corrected as shown below:

Column 3, line 12, delete "of"

Column 9, line 6, change "end" to --ends--

Signed and Sealed this

*Tenth* Day of *August 1982*

[SEAL]

*Attest:*

GERALD J. MOSSINGHOFF

*Attesting Officer* *Commissioner of Patents and Trademarks*